United States Patent [19]

Bonzo

[11] 4,184,653

[45] Jan. 22, 1980

[54] SPOOL FOR FILAMENT WINDER

[75] Inventor: Roy T. Bonzo, Painted Post, N.Y.

[73] Assignee: Corning Glass Works, Corning, N.Y.

[21] Appl. No.: 903,001

[22] Filed: May 4, 1978

[51] Int. Cl.[2] ..... B65H 75/28

[52] U.S. Cl. ..... 242/125.1; 242/18 PW

[58] Field of Search ..... 242/125.1, 125, 125.2, 242/18 PW, 18 EW, 18 A

[56] References Cited

U.S. PATENT DOCUMENTS

| | | | |
|---|---|---|---|
| 2,079,966 | 5/1937 | Reiners et al. | 242/125.1 |
| 2,501,515 | 3/1950 | Hood | 242/125.1 |

FOREIGN PATENT DOCUMENTS

| | | | |
|---|---|---|---|
| 2647528 | 4/1978 | Fed. Rep. of Germany | 242/125.1 |

*Primary Examiner*—George F. Mautz

*Attorney, Agent, or Firm*—William J. Simmons, Jr.; Walter S. Zebrowski

[57] ABSTRACT

A spool is disclosed for winding an optical waveguide filament during the drawing thereof. Each end of the spool is provided with an annular resilient member which forms a part of a channel for receiving the filament. The resilient member must be displaced while the filament is in contact therewith to provide a gap through which the filament can pass. After the gap closes, the filament is gripped by the resilient member. In this manner both ends of a wound filament can be secured to the ends of a spool.

3 Claims, 9 Drawing Figures

SPOOL FOR FILAMENT WINDER

BACKGROUND OF THE INVENTION

This invention relates to a spool having means at the ends thereof for automatically gripping a filament to be wound thereon. Such a spool is particularly useful in an apparatus for continuously winding filament, thread or the like on a plurality of spools.

There is presently a need for an apparatus for continuously winding glass optical waveguide filament on a plurality of spools during the drawing thereof. Such apparatus must have means for automatically changing spools, i.e., removing from the winding station a spool that is full, severing the filament from the full spool, and attaching the filament to an empty spool that has been moved into the winding station.

The spool of the present invention is particularly applicable to the winding of relatively fragile filaments such as glass optical waveguides. The characteristics of such optical waveguides and methods of making the same are disclosed in the publication "Doped-Deposited-Silica Fibres For Communications" by R. D. Maurer, Proc. IEE, Vol. 123, No. 6, June, 1976, pp. 581–585. Such fibers are manufactured by initially forming a glass preform from which filaments are drawn. Drawing speeds up to 2 meters per second have been achieved, and speeds up to 5 meters per second are anticipated in the near future. Up to 15 km of filament have been produced from a single glass blank, and the drawn filament is wound on spools containing as little as 25 meters per spool. After the desired length of filament is wound on a spool, it is very difficult if not impossible for an operator to change spools by hand when filament drawing speeds exceed one meter per second. An automatic apparatus for performing this function must be capable of removing a full spool from the winding station, attaching the filament to an empty spool and continuing to wind the filament without breaking it or causing damage thereto, without interrupting the drawing of the filament and without generating an undue amount of waste filament. The filament should not be sharply bent, and the ends thereof should protrude from the spools to facilitate the connection of testing equipment thereto. Presently available spools are incapable of meeting these requirements.

SUMMARY OF THE INVENTION

It is therefore an object of the present invention to provide an improved spool for use in an automatic filament system.

Briefly, the spool of the present invention comprises a cylindrically shaped body having a longitudinally disposed bore therethrough. A first annular member is circumferentially disposed around one end of the body, and an annular resilient member is circumferentially disposed around said body adjacent the first member. The space between the first and second members constitute a filament receiving region.

DESCRIPTION OF THE PREFERRED EMBODIMENT

It is to be noted that the drawings are illustrative and symbolic of the present invention, and there is no intention to indicate the scale or relative proportions of the elements shown therein. The present invention will be described in connection with the winding of optical waveguide filaments although this invention is not intended to be limited thereto.

Figure 1:
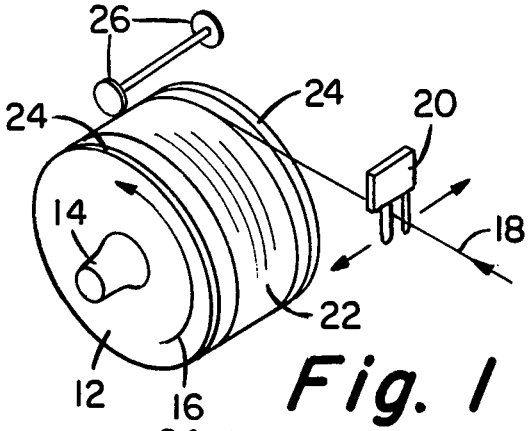
FIG. 1 shows a portion of a filament winding apparatus.

FIG. 1 shows a portion of a winding apparatus in which the spool of the present invention may be employed. Spool 12 is disposed on a spindle 14 which rotates in the direction of arrow 16. The position of filament 18 on spool 14 is determined by filament guide 20. The filament is wound on a central region 22 of the spool and is attached to gripping means 24 located at the ends of the spool. Rollers 26 are brought into contact with gripping means 24 in a manner to be discussed in greater detail below in order to capture and retain the filament. Rollers 26 preferably include a tire of soft material such as rubber so that they do not abrade the filament.

Figure 2:
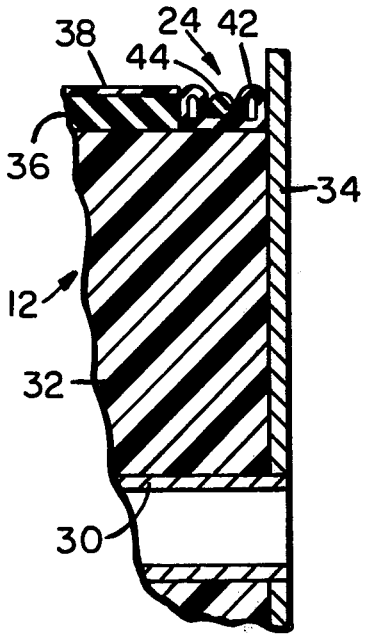
FIG. 2 is a partical cross-sectional view of a spool constructed in accordance with the present invention.

A preferred embodiment of spool 12 is shown in FIG. 2. Plastic tube 30 is disposed in an aperture extending through cylindrical styrofoam body 32, the ends of which are provided with plastic flanges 34. A foam rubber layer 36 is disposed around body 32 to cushion the filament. Layer 36 may be covered by a thin plastic layer 38. Gripping means 24, which is disposed at each end of body 32 between flange 34 and layer 36, comprises a hump rubber extrusion 42 having a rubber O-ring 44 disposed between the two humps thereof. The region between one of the humps 42 and O-ring 44 is referred to herein as the pinch line.

The winding spool of the present invention is advantageously employed in a system for winding glass optical waveguide filaments. It is desirable to test such filaments on the spool immediately after they are drawn. Foam rubber layer 36 helps to relieve stresses in the wound filament that could cause the testing apparatus to record loss which could be induced by such stress. Moreover, filament gripping means 24 facilitates the attachment of the filament to the spool in such a manner that the ends thereof protrude from the spool for attachment to the testing apparatus.

Figure 3:
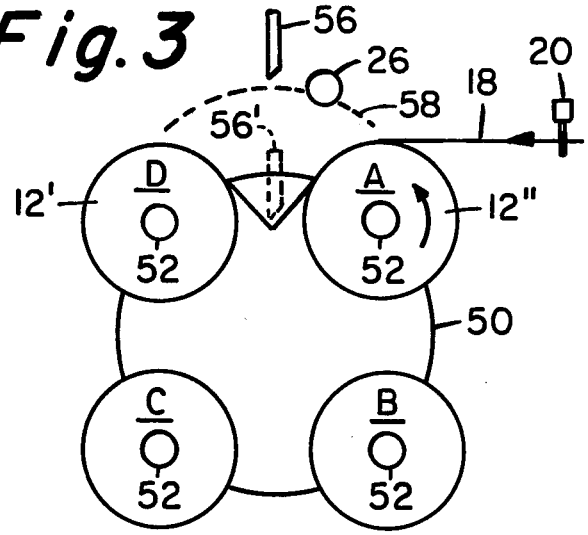
FIG. 3 is a diagram illustrating the operation of a spool changing apparatus.

Referring to FIG. 3 there is shown a vertical indexing turret winder having four stations: wind station A, wait station B, load station C and unload station D. The winder comprises turret plate 50, around the circumference of which are disposed equally spaced spindles 52. Empty spools are loaded in station C and full spools are removed in station D. A detailed description of this winding system is set forth in commonly assigned U.S. patent application Ser. No. 902,977 entitled "Winding Apparatus for Glass Optical Filaments" filed on even date herewith, now U.S. Pat. No. 4,138,069, said application being incorporated herein by reference.

Turret plate 50 is indexed 90° during each cycle. The spindles in stations A and B rotate at the winding speed, and that at station D rotates at the winding speed until the filament extending between spools at stations A and D has been severed. A cut knife 56 includes a blade having V-grooves which are located in the planes extending through the pinch lines of the spools of stations A and D. Thus, when a filament extends between one of the pinch lines of the spool of station A and the corresponding pinch line of the spool of station D, the filament extends directly beneath a corresponding V-groove of knife 56. The knife is so designed that it does not cut the filament on contact but can depress the filament as shown in FIG. 3 wherein the knife is schematically repesented. When the knife reaches the position illustrated by dashed lines 56', the knife blades are caused to move horizontally and cut the filament which is then located at the bottom of the V-groove. About one second after the filament extending between the spools of stations A and D has been severed, the full spool in station D stops rotating. Thereafter, means is actuated to remove the spool from station D.

Figure 4:
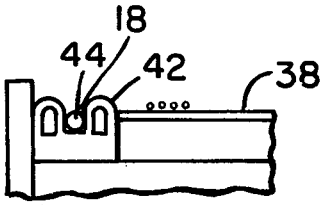
FIGS. 4, 5 and 6 illustrate the manner in which a filament is retained by the gripping means of the spool of FIG. 2.
Figure 5:
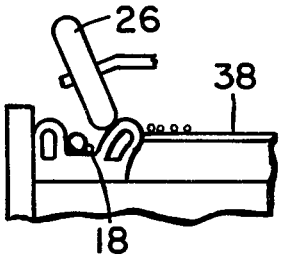
Figure 6:
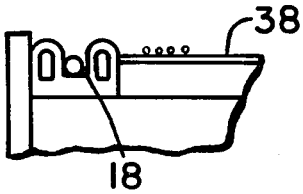

The manner in which a filament is caused to be gripped by means 24 is illustrated in FIGS. 4–6. As shown in FIG. 4 filament 18 is guided from plastic layer 38 to the pinch line between a section of the hump rubber extrusion 42 and O-ring 44. The winding tension is insufficient to cause the filament to pass through the pinch line at the point of contact between numbers 42 and 44. While the spool is turning, roller 26 moves to the position shown in FIG. 5 and depresses the hump rubber away from the O-ring, thereby creating a gap through which the filament falls. Since the spool is turning, the gap is always forming and closing as the rubber hump passes under the roller. After the roller retracts the gap remains closed.

The operation of the disclosed winding apparatus is as follows. With filament guide 20 in line with one of the end sections of the spool in station A, filament 18 is threaded through the filament guide and over the respective pinch line of the spool. The pinch line rollers are actuated so that a gap between members 42 and 44 is opened and the filament falls therethrough as illustrated in FIG. 5. As the roller passes, the gap closes, thereby causing the filament to be captured by such gripping means. Guide 20 then guides the filament to the winding section 22 of the spool, and filament 18 is wound across plastic layer 38. When the spool is full, guide 20 positions the filament in the pinch line at the opposite end of the spool. Turret plate 50 then indexes 90° causing the full spool from station A to be positioned at station D. As the full spool is being indexed to station D, it contacts rollers 26 as illustrated by dashed line 58 in FIG. 3. This momentarily opens the gap between members 42 and 44 causing the filament to be captured thereby. As an alternative method of operation, rollers 26 can be positioned above the path of rotation of the full spool and can be lowered into contact with the full spool while it is still in station A.

As a full spool indexes out of the winding station, an empty spool indexes in, the filament being automatically positioned in the pinch line of the empty spool but traveling over it until the rollers open the gap. In FIG. 3 the full and empty spools are represented by numerals 12' and 12'', respectively. With the index complete, rollers 26 descend and open the pinch line gap at the edge of the spool in station A to permit the filament to fall therein. Until the filament extending between spools 12' and 12'' is cut, it is continuously pulled out of the gripping means of spool 12'' and is wound around the gripping means of spool 12'. The cut knife then deflects downwardly the filament extending between spools 12' and 12''. This deflection of the filament increases the length of filament which is in the pinch line gap of spool 12'' prior to cutting and makes the transfer of filament to spool 12'' more reliable. As soon as the filament is cut, it remains in the gripping means of spool 12''. The rollers can be retracted simultaneously with the cutting of the filament or just thereafter. Spool 12' stops rotating about one second after the filament is cut, and the full spool is now free to be unloaded. Knife 56 then retracts. Guide 20 then moves the filament back onto region 22 of the newly started spool which begins to wind filament.

Figure 7:
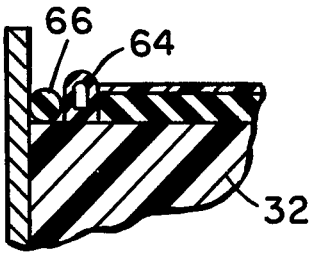
FIGS. 7, 8 and 9 are partial cross-sectional views of alternative embodiments.
Figure 8:
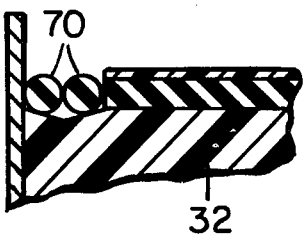
Figure 9:
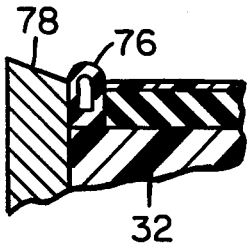

Other types of filament gripping means are illustrated in FIGS. 7–9. In FIG. 7 a single hump hollow rubber extrusion 64 is disposed adjacent O-ring 66, the pinch line existing therebetween. An advantage of employing a hollow member such as extrusion 64 lies in its ability to be easily deflected a sufficient distance to permit the passage of a filament between it and the adjacent member.

In FIG. 8 the pinch line is disposed between two O-rings 70. In this embodiment the surface of body 32 under O-rings 70 contains a shallow V-shaped groove which causes the O-rings to bear against one another to maintain a closed pinch line except when roller 26 creates a gap.

From the above-described embodiments it can be seen that the basic requirement of the gripping means is an annular, resilient member that is normally disposed against the adjacent surface of another annular member. This is illustrated in FIG. 9 wherein annular, resilient member 76 is disposed around one end of cylindrical body 32. The adjacent annular member 78 has a surface which is in contact with member 76 and forms a pinch line therewith. Member 78 can consist of resilient or rigid material and could be the end flange of the spool. The outer circumferential surface of member 78 is preferably tapered toward member 76 to cause a filament that is positioned thereon to slide into abutment with member 76. Any surface over which the filament passes, such as the surface of member 76 and that of the winding region of the spool, should consist of a soft material such as plastic or rubber to avoid abrading the surface of a glass filament.

I claim:

1. A spool adapted for use in the winding of filament, said spool comprising a cylindrically shaped body having a longitudinally disposed bore therethrough, a first annular member circumferentially disposed around one end of said body, and an annular resilient member circumferentially disposed around said one end of said body adjacent said first member, the space between said first member and said resilient member constituting a filament receiving region, said resilient member being flat on the side thereof which contacts said body, the opposite side of said resilient member having two spaced hollow rounded portions, said first member comprising an O-ring disposed between said spaced rounded portions.

2. A spool adapted for use in the winding of filament, said spool comprising a cylindrically shaped body having a longitudinally disposed bore therethrough, a first O-ring circumferentially disposed around one end of said body, and a second resilient O-ring circumferentially disposed around said one end of said body adjacent said first O-ring, the space between said first and second O-rings constituting a filament receiving region, that portion of said body adjacent to said first and second O-rings having a shallow, V-shaped groove.

3. A spool adapted for use in the winding of filament, said spool comprising a cylindrically shaped body having a longitudinally disposed bore therethrough, a first annular member circumferentially disposed around one end of said body, and a hollow, annular member of resilient material circumferentially disposed around said one end of said body adjacent said first member, the space between said first member and said resilient member constituting a filament receiving region, said resilient member being flat on the side thereof which contacts said body, said resilient member having two hollow spaced, rounded portions on the side thereof opposite said flat side, said first annular member being disposed between said two rounded portions.

* * * * *